US006165039A

United States Patent [19]

Cobane

[11] Patent Number: 6,165,039

[45] Date of Patent: Dec. 26, 2000

[54] BALLOON AND GONDOLA TOY

[76] Inventor: Steven L. Cobane, 2481 Eden SW., Wyoming, Mich. 49509

[21] Appl. No.: 09/251,005

[22] Filed: Feb. 16, 1999

Related U.S. Application Data

[60] Provisional application No. 60/074,908, Feb. 17, 1998.

[51] Int. Cl.[7] ..... A63H 3/06; A63H 33/00

[52] U.S. Cl. ..... 446/220; 446/489

[58] Field of Search ..... 446/220, 223, 446/225, 222, 226, 77, 489

[56] References Cited

U.S. PATENT DOCUMENTS

| | | | |
|---|---|---|---|
| 208,637 | 10/1878 | Schwartz | 446/225 |
| 344,515 | 6/1886 | Biehl | 446/220 |
| 1,427,396 | 8/1922 | Keith | 446/225 |
| 1,478,755 | 12/1923 | Mulholland | 446/220 |
| 1,718,349 | 6/1929 | Gordon | 446/225 |
| 2,397,364 | 3/1946 | Myers | 446/488 X |
| 2,709,319 | 5/1955 | Baltin | 446/488 X |
| 2,833,074 | 5/1958 | Jannes | 446/488 X |
| 4,145,838 | 3/1979 | Mason | 446/220 |
| 4,307,537 | 12/1981 | Bergmann | 446/222 X |
| 4,758,199 | 7/1988 | Tillotson et al. | 446/225 |
| 4,810,223 | 3/1989 | Stockton | 446/225 X |
| 5,531,401 | 7/1996 | Newcomb | 446/225 X |

*Primary Examiner*—D. Neal Muir

[57] ABSTRACT

A hot air balloon toy 10 that consists of a helium or air filled balloon 12 and an attached gondola 14. The gondola 14 is formed from a sheet of flexible, lightweight, material and having a top portion 16, bottom portion 24, and intermediate portion 20. The top portion 16 is formed into an annulus shape, with the shape being maintained with the use of a fastening means 18. The bottom portion 24 is in the form of a container, with the container shape being maintained with the use of a fastening means 28. The gondola is attached to the balloon with the use of an adhesive stopper 42 that is placed on the balloon tether 40 underneath the floor flap 32 and next to a hole 38 in floor flap. The spring-like action of intermediate sides 20 helps to hold the gondola 14 firmly against the balloon 12.

7 Claims, 5 Drawing Sheets

BALLOON AND GONDOLA TOY

BACKGROUND—CROSS REFERENCE TO RELATED APPLICATION

Figure 1:
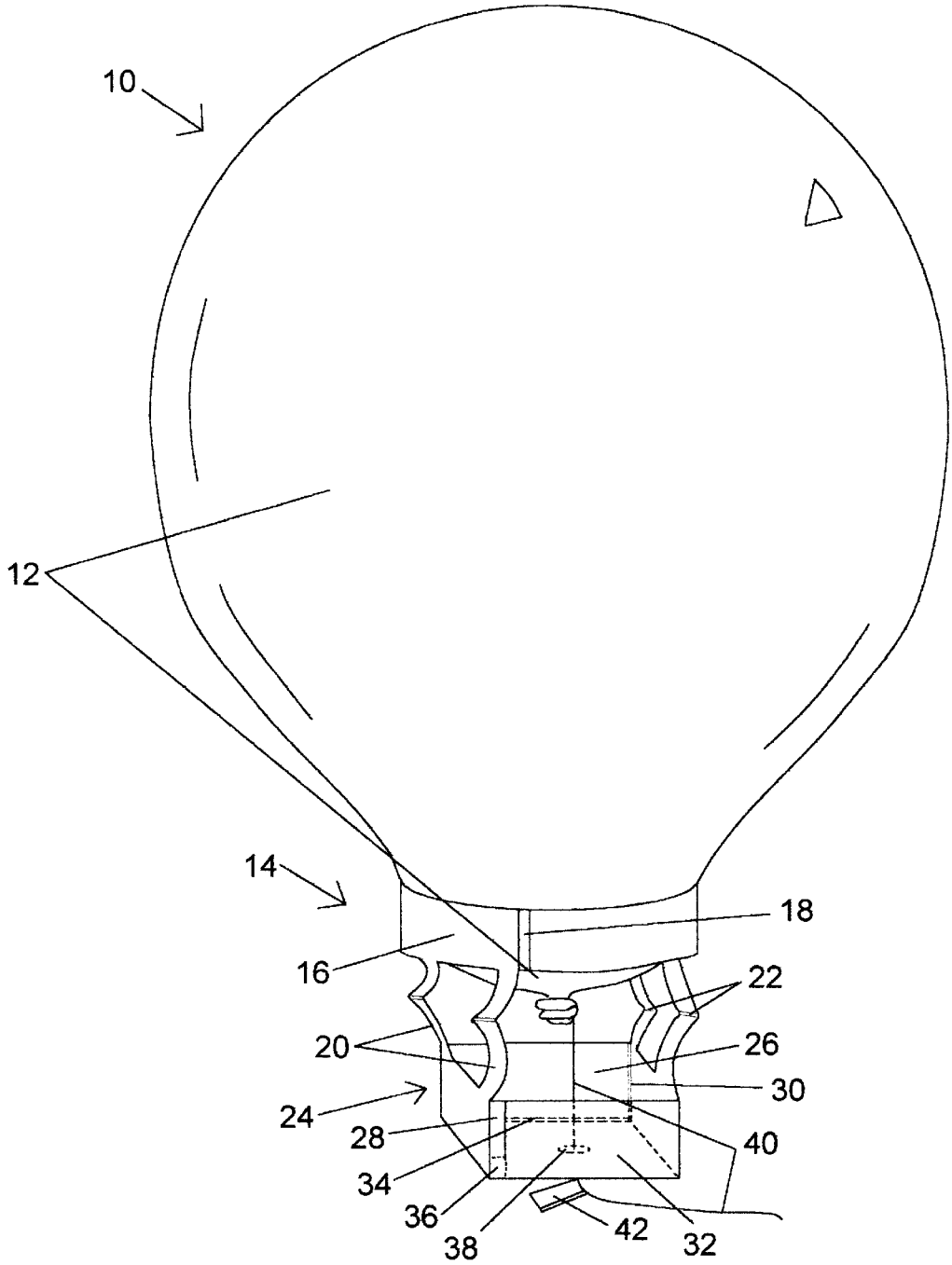

This application claims the benefit of Provisional Patent Application Ser. No. 60/074,908, filed Feb. 17, 1998.

BACKGROUND—FIELD OF INVENTION

This invention relates to an aerial toy and more specifically to a "hot air" balloon gondola toy that is formed from a flat, flexible, lightweight material and then attached to a helium or air filled balloon.

BACKGROUND—DESCRIPTION OF PRIOR ART

When one thinks of the word "balloon", two visions come to mind. First, is the large colorful hot air balloons that float high in the clouds on a summer day. The same balloons that highlight several hot air balloon events across the world, and delight thousands of spectators. Second, is the helium or air filled balloon that is used to decorate parties and celebrations, or used for advertising for an organization or event.

This invention brings these two visions together. It changes the smaller balloon into a miniature hot air balloon toy. A toy that can still be lighter than air if the balloon is filled with helium. The balloon and gondola toy combination will be used in the same general manner as a helium or air-filled balloon, however it will provide more flexibility in the quantity and quality of written material or artwork that can used on the toy. The new hot air balloon appearance will also give the balloon added novelty, thus sparking the imagination of both children and adults.

Several attempts have been made at a balloon-gondola combination, however they contain several differences and disadvantages from this invention. In U.S. Pat. No. 4,784,628 to McArlde (1988), the clipped or tied end of the balloon neck is stretched downward through a locking disk that is attached to the inner sidewall of the skirting of the gondola. The elasticity of the balloon pulls and holds the gondola against the balloon, while the locking disk prevents the clip or knot on the balloon filling stem from passing through. Attached to the locking disk are suspension cords that are attached to the floor thus giving appearance of a gondola basket. The assembly of the interlocking disk to the skirting, and the assembly of the suspension cords to the interlocking disk would either require complicated manufacturing methods if mass produced, or would require, the end user to have several small intricate pieces to put together.

U.S. Pat. No. 4,884,987 (Mason 1989) has a similar disadvantage. The clipped or tied end of the balloon is stretched downward and passed through a keyhole slot that is cut in a cross wall inserted in a conventional drinking cup. The elasticity of the balloon pulls and holds the gondola on the balloon while the keyhole slot prevents the tied end from passing through. The assembly of the cross wall against the inner sidewall of the drinking cup would either require a complicated manufacturing process or would need to be hand crafted. (Mason 1989) also introduces a method of using the bottom of a conventional cup as the cross wall by "bonding separate components, or by forming them integrally of one another." Again this would require a special manufacturing process to mass produce thus adding to the costs of production.

Both U.S. Pat. Nos. 4,784,628 (McArlde 1988) and 4,884,987 (Mason 1989) use devices for attaching the gondola to the balloon that not only provide manufacturing challenges but also increase the amount of weight to the gondola. Every small addition of weight shortens the life of how long the balloon will fly with the gondola attached. In addition, neither patent offers any suggestions regarding how it can be packaged or stored if sold in retail stores. My invention offers some solutions to all of these challenges.

OBJECTS AND ADVANTAGES

Accordingly, the several objects and advantages that in this present invention are:

(a) to provide a product that has no small and intricate pieces needing timely assembly or requiring a complicated manufacturing process.

(b) to provide a product that is lightweight and that will be lighter-than-air when attached to a helium balloon for several hours.

(c) to provide a product that is originally presented flat so that it can b easily stacked, packaged and stored.

(d) to provide a product that is originally presented flat so that it can minimize space when packaged and displayed in retail stores.

(e) to provide a product that is easy to assemble and easy to attach to a helium balloon.

(f) to provide a product that can be easily printed to accommodate to the needs of the occasion or the needs of the advertiser.

Further objects and advantages of my invention will become apparent from a consideration of the drawings and ensuing description.

DRAWING FIGURES

FIG. 1—is a view of both the balloon and the attached gondola, after the gondola is assembled.

Figure 2:
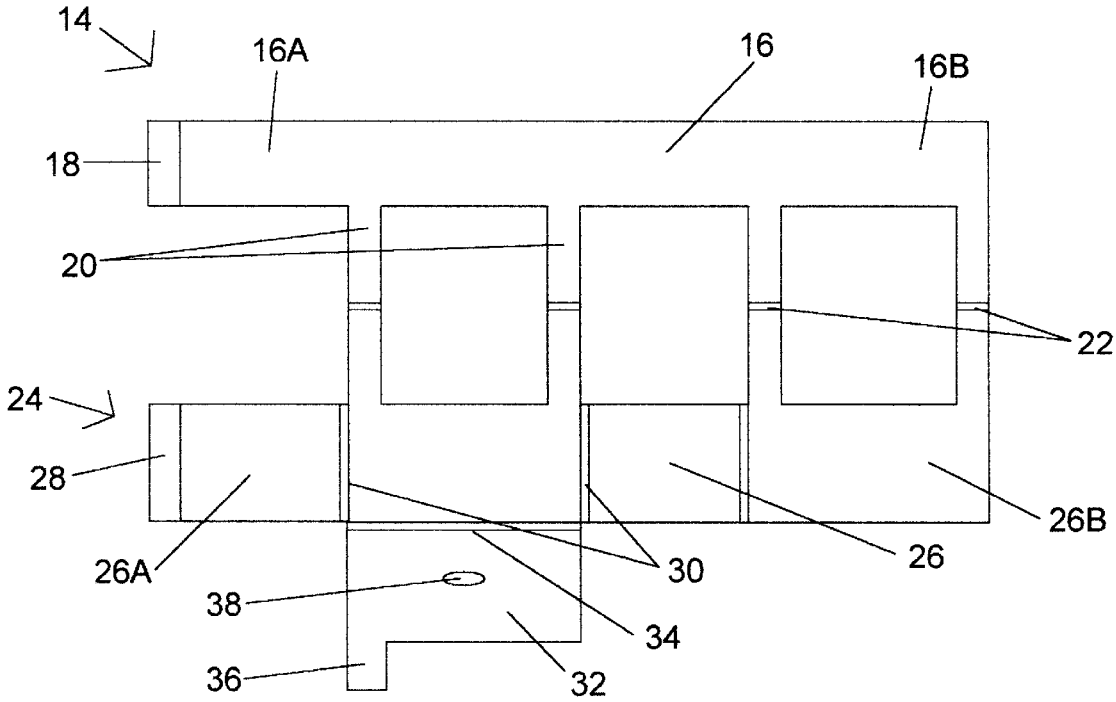

FIG. 2—is a view of the flat gondola unassembled and unattached to balloon.

Figure 3:
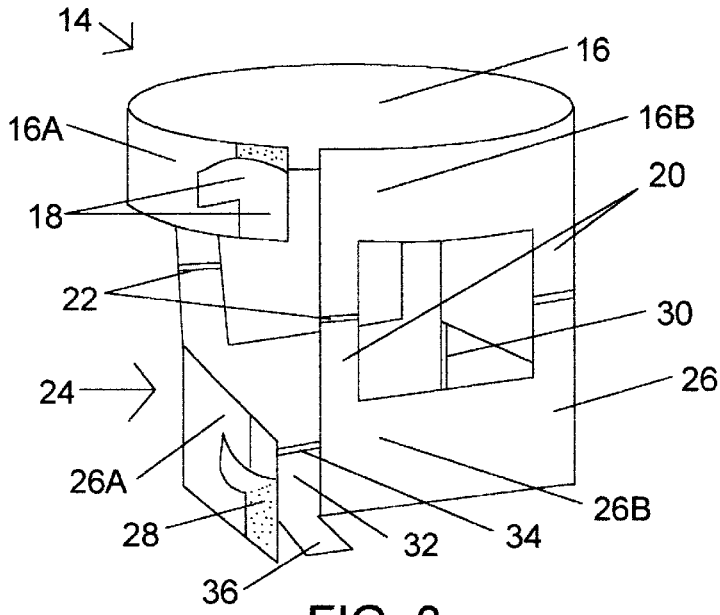

FIG. 3—is a view before assembly to show how that the remote sides on top and bottom portion and floor flap will bend together to form the gondola.

Figure 4:
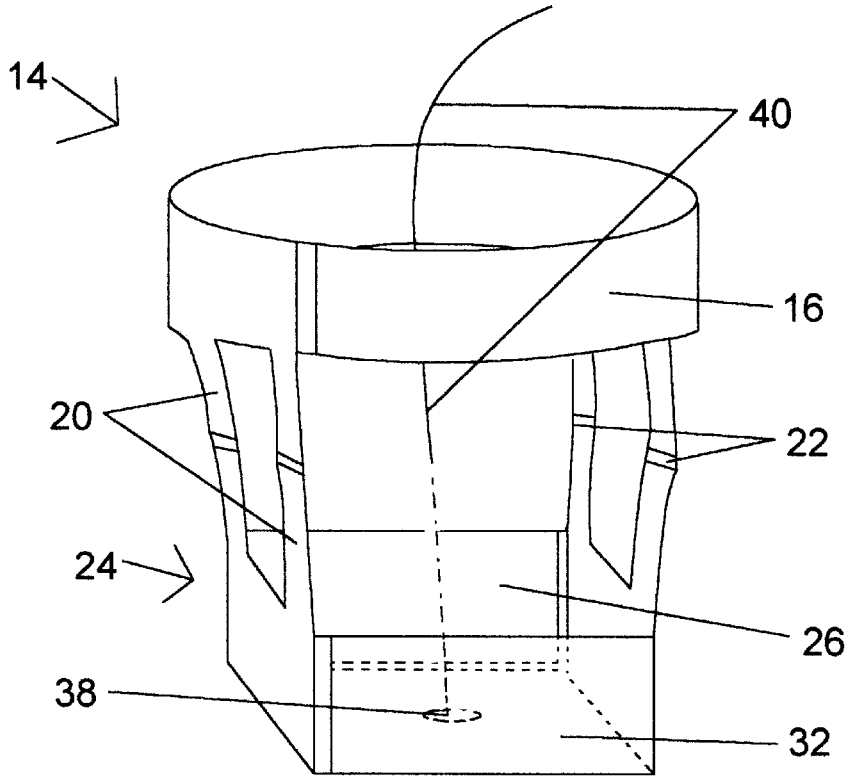

FIG. 4—is a view to illustrate how the balloon tether will be inserted through the top ring and through a small slit or hole cut in the floor flap.

Figure 5:
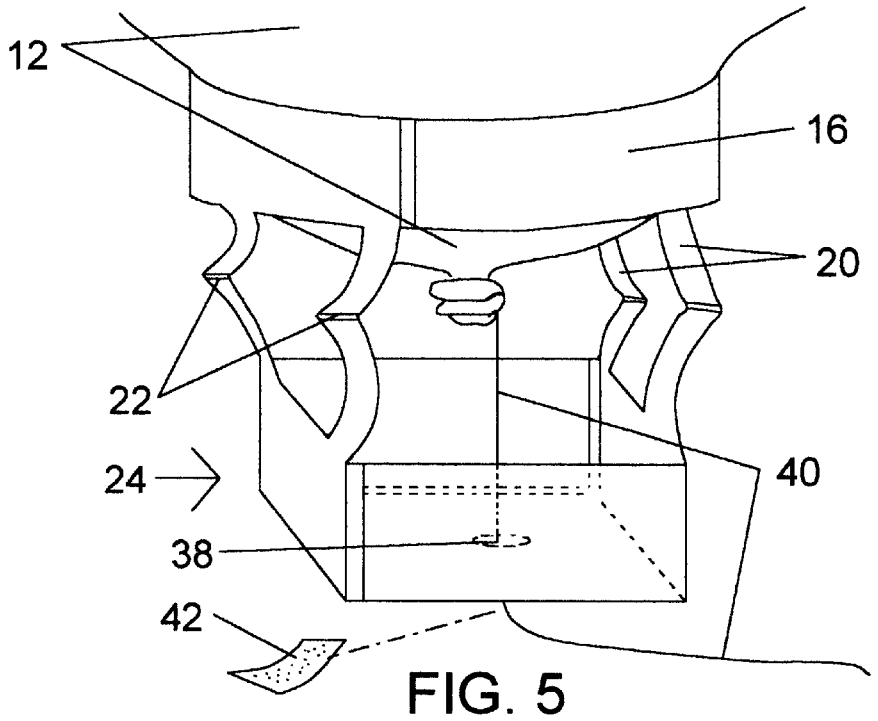

FIG. 5—a view to illustrate how the top of gondola is placed against bottom of balloon and that the adhesive stopper will be will be placed on tether closely near the hole at basket floor.

Figure 6:
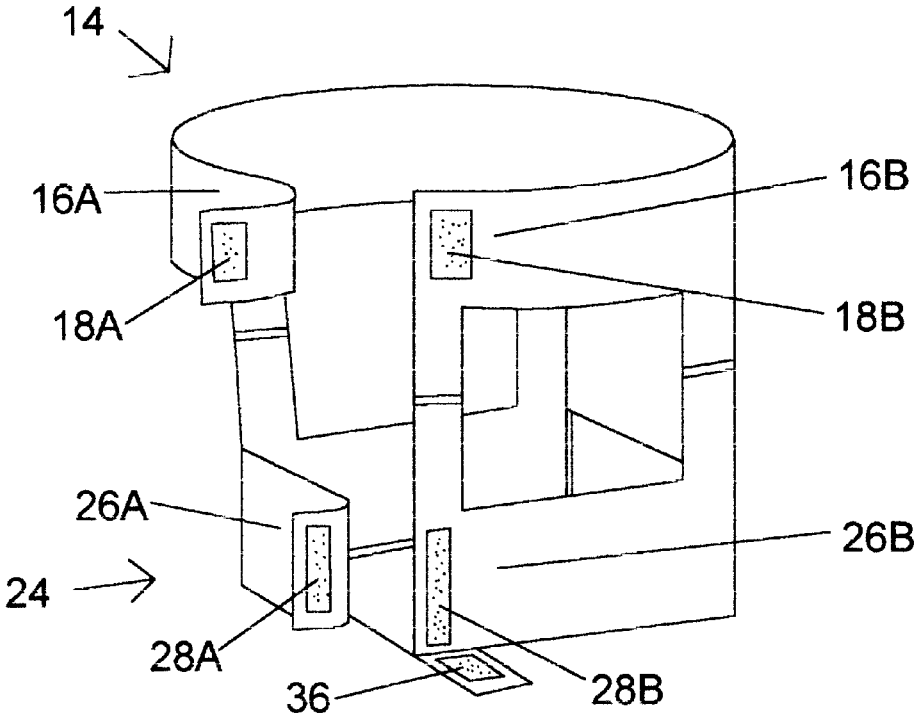

FIG. 6—shows how using hook and loop strips can be used to assemble the gondola.

Figure 7:
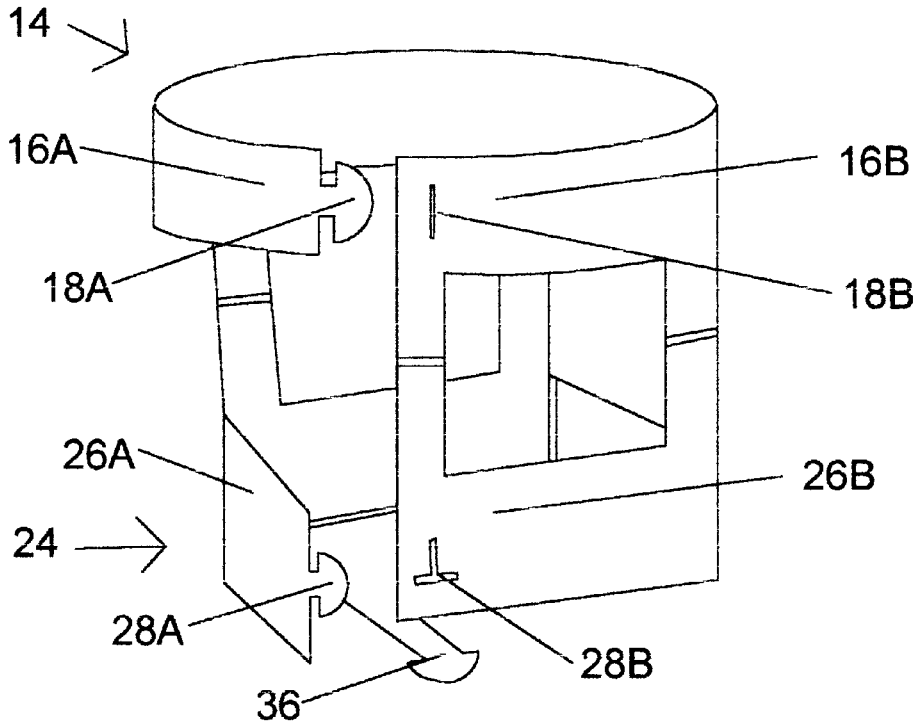

FIG. 7—shows how an interlocking tab and slit method be used to assemble the gondola.

Figure 8:
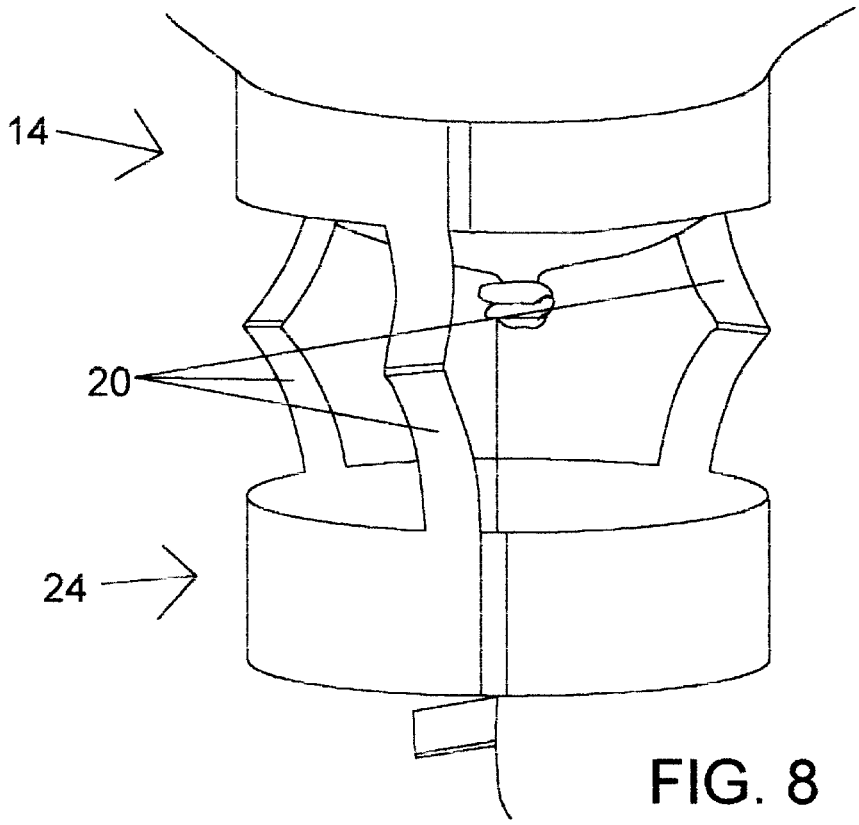

FIG. 8—shows how the gondola can have three sides and an oval shaped basket.

Figure 9:
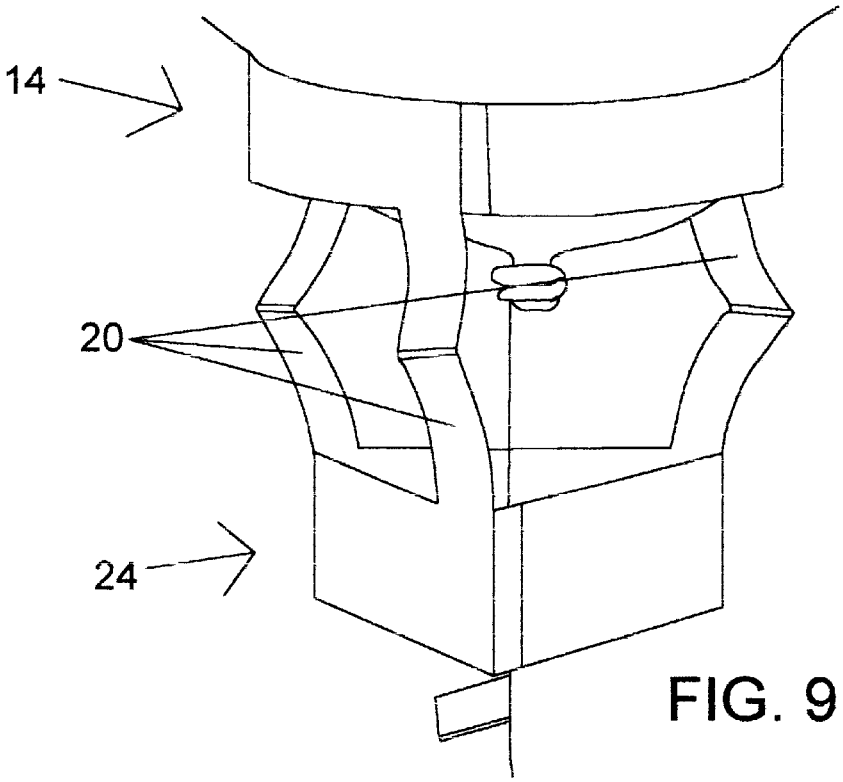

FIG. 9—shows how a gondola can have three sides and a triangular shaped basket.

Reference Numerals In Drawings

| | |
|---|---|
| 10 balloon with attached gondola | 12 balloon |
| 14 gondola | 16 top portion |
| 18 fastening means for top portion | 20 intermediate portion |
| 22 scores on intermediate portion | 24 bottom portion |

-continued

| Reference Numerals In Drawings | |
|---|---|
| 26 elongated strip of bottom portion | 28 fastening means for bottom portion |
| 30 scores on elongated strip | 32 floor flap of bottom portion |
| 34 scores on floor flap | 36 floor flap tab |
| 38 hole or slit in floor flap | 40 balloon tether |
| 42 adhesive stopper | |

SUMMARY

In accordance with the present invention a balloon and gondola toy comprising an inflatable toy balloon with tether, and an attached gondola that is formed from a sheet of lightweight flexible material.

Description—FIGS. 1,2

(FIG. 1) This "hot air" balloon toy 10 is comprised of a helium or air filled balloon 12 that is used to simulate the envelope of a real hot air balloon, and an attached gondola 14. The gondola 14 has a top portion 16, bottom portion 24, and intermediate portion 20. The top portion 16 is formed into an annulus shape with the aid of a fastening device 18. The bottom portion 24 consists of a strip 26, a floor flap 32, and a floor flap tab 36, which are formed into a container shape with the aid of a fastening device 28. There may be scores 30 formed into the material on the elongated strip 26, and scores 34 on the floor flap that will aid in the forming of the bottom portion. The gondola 14 is attached to the balloon by the use of a small piece of adhesive 42 that will be referred to as the adhesive stopper. This adhesive stopper is attached to the balloon tether 40, next to a small hole or slit 38 that is cut into the basket floor 32. When the gondola 14 is pressed against the bottom of the balloon 12, the intermediate portion 20 will become spring-like because of scores 22 that are formed into the material.

(FIG. 2) The unassembled gondola is made from a flat, lightweight, flexible material, such as paperboard, foam plastic or rubber, thin plastic, or any other material that can perform the same function and can be conceived by someone skillful in the art. This flat unassembled gondola 14 has a top portion 16 that is in the form of an elongated strip with two remote short sides 16A and 16B. At the end of one or both of the short sides will be a device or devices 18 used for fastening. The bottom portion of the gondola 24 when formed will resemble the basket of a hot air balloon. The bottom portion consists of an elongated strip 26 with two remote short sides, 26A and 26B and a floor flap 32 that extends downward from the bottom edge of the strip 26. The floor flap 32 will have a hole or slit cut into the material 38 and at least one small tab 36 extending from the edge. At the end of one or both of the short sides 26A and 26B will be a device or devices 28 used for fastening. The elongated strip 26 may have scores 30 formed into the material where it will be bent and formed into a defined shape. The floor flap 32 may have lines scored into the material 34 where it connects with the elongated strip 26.

The intermediate portion consists of about three or four horizontal strips 20 that extend downward from the top portion 16 and connects to the elongated strip 26 of the bottom portion 24. On these intermediate portion strips 20 there are lines scored into the material 22 that will enable the strips to act as springs. When the top portion and bottom portion are assembled, the intermediate portion 20 will then reassemble the ropes or bars of an actual hot air balloon.

The unassembled gondola in FIG. 2 as described above, will be formed to produce the finished assembled gondola as presented in FIG. 1. Because it is first presented flat, the unassembled gondola can be easily stacked, stored and packaged for sale to the end users. The flat gondola can also be printed in many different designs and colors to promote several occasions, or to advertise for companies and organizations.

Operation—FIGS. 3 to 5

The forming of the unassembled gondola to an assembled gondola attached to a balloon, can be done in the following steps:

Step 1). (FIG. 3) The two remote ends of the top portion 16A and 16B are brought together to form an annulus shape and then assembled by a fastening means 18. In this illustration, remote side 16A has an adhesive strip 18 that is peeled off so that the other remote side 16B can be attached when it is overlapped and pressed against the adhesive strip 18. This is one possible method of fastening. The remote sides 16A and 16B can be attached by an method that can be conceived by someone with ordinary skill in the art. Two other examples of fastening means will be presented further in the Alternative Embodiments.

Step 2). (FIG. 3) The two remote sides of the bottom portion elongated strip 26A and 26B are brought together and the floor flap 32 is folded inward. The two remote sides 26A and 26B and the floor flap tab 36 are then fastened together with the use of a fastening means. In this illustration, remote side 26A has an adhesive strip 28 that is peeled off. The floor flap 32 is folded inward and the floor flap tab 36 is attached to the adhesive 28. The floor flap may have scores 34 formed into the material that can aid in the process of folding inward. The second remote side 26B is then brought together with remote side 26A and floor flap tab 36 and attached to the adhesive 28. There may be scores 30 formed into the material of the bottom portion elongated strip 26 that will aid in forming the bottom portion into a specific container shape. The remote ends 26A and 26B and the floor flap tab 36 can be attached by any method that can be conceived by someone with ordinary skill in the art. Two other methods of fastening will be presented further in the Alternative Embodiments.

Step 3). In FIG. 4 14, a completely assembled gondola unattached to the is illustrated. The next step is to take the balloon tether 40, and insert it downward through the top portion 16, into the bottom portion container 24, and through the small hole or slit 38. To aid in this process, the top portion 16 can be pushed downward toward the basket so that the distance between the top portion 16 and the basket floor 32 is shortened. This is possible because the intermediate portion 20 has a spring-like quality due to the scores 22 that are formed into the material.

Step 4). (FIG. 5) After the balloon tether 40 is almost completely) threaded through the gondola floor 32, the gondola 14 is pushed slightly against the bottom of the balloon 12. This causes the intermediate portion strips 20 to slightly bend and become spring-like due to the scores 22. With the gondola 14 held in place against the bottom of the balloon 12, the adhesive stopper 42 is placed on the balloon tether 40 closely near the floor flap hole 38. The adhesive stopper 42 may or may not be originally attached to the flat gondola prior to placing it on the balloon tether. The gondola is now attached to the balloon.

Description and Operation—Alternative Embodiments FIGS. 6 to 9

An alternative to the process described above, would be to take the balloon tether 40 and thread it through the floor flap hole 38 before assembling the top portion 16 and bottom portion 24. The method for attaching the gondola to the balloon, by the use of the adhesive stopper, and the appearance of the hot air balloon toy will remain the same.

FIG. 6 and FIG. 7 show alternative methods for assembling the gondola top portion remotetop portion 16 and bottom sides 16A and 16B, and bottom portion 24. stopper, and the appearance of the hot air balloon toy will remain the same.

In FIG. 6, hook and loop fastening strips 18A and 18B are used to attach remote sides 16A and 16B when remote sides are overlapped over the strips. The bottom portion 24 also has hook and loop fastening strips attached to remote sides 28A and 28B and to floor flap tab 36. The method of assembling would be identical to that of the adhesive method, however there would be no adhesive covering to peel off.

FIG. 7 illustrates how the top portion remote sides 16A and 16B can be assembled by the use of an interlocking tab 18A on remote side 16A that can fit into a slit 18B on remote side 16B. The bottom portion 24 also has an interlocking tab 28A on remote side 26A that fits into slit 28B on the other remote side 26B. The floor flap tab 36 will fit into slit 28B on remote side 26B.

Thus far, the illustrations used for the description and operation have used a rectangular shaped container for the basket, and have shown four strips for the intermediate sides. However, this patent is not limited to either one of these characteristics. FIG. 8 and FIG. 9 show some alternatives. Both FIG. 8 and FIG. 9 have three intermediate sides 20. In FIG. 8, the bottom portion 24 is in a cylinder shape. In FIG. 9 the bottom portion 24 is in a triangular shaped container.

Conclusion, Ramifications, and Scope

Accordingly, the reader will see that the balloon and gondola toy presented in this patent will be both easy to assemble and easy to attach to the balloon. In addition, the manufacturing methods used in the printing, die cutting, and application of double-sided adhesive, are commonplace with many commercial printers. Thus, the manufacturing of this toy will not require any methods that are already available. The gondola toy can be printed with any advertised message or artwork promoting an organization or event. It will be used in any situation where a helium or air filled balloon can be used. Such uses include: retail stores, retail sales at events (such as a hot air balloon show), decorating, campaign advertising, company advertising (such as a car dealership, or realtor) etc. Because it is first presented flat it will be easily stacked, packaged and stored for all of these uses.

The gondola in this invention does not require any small parts to assemble, and since it is made of a flexible, lightweight material, it will be safe to the consumer.

Although the description above contains many specifications, these should not limit the scope the this invention. For example, the size of the gondola could depend on the size of balloon used. If a 16 inch balloon was used instead of a standard 11 or 12 inch balloon, then the gondola could be made larger. In another example, the tether that is illustrated is presumed to be a ribbon or string. However, if the balloon is air filled, then the tether can be in the form of a stick.

Thus the scope of the invention should be determined by the appended claims and their legal equivalents, rather than by the examples given.

What is claimed is:

1. An inflated balloon and gondola comprising:

a balloon with neck, inflated and sealed at said neck, said gondola having top, intermediate, and bottom portions, all being of lightweight sheet material, said top portion being an elongated strip formed into an annulus and contacting the balloon, said intermediate portion being of a least three narrow strips of said sheet material depending from said top portion linking to said bottom portion, said bottom portion having upstanding sides and a floor, said floor having an aperture, said balloon having a tether attached to said sealed neck and depending through said floor aperture while being contacted to said floor, whereby said tether holds said gondola to said inflated balloon.

2. The inflated balloon and gondola as described in claim 1, wherein said narrow strips of said intermediate portion having horizontal scores in said lightweight material, whereby said intermediate portion is biased having spring-like attributes.

3. The inflated balloon and gondola as described in claim 1, wherein said elongated strip is maintained into said annulus by use of a fastening means.

4. The inflated balloon and gondola as described in claim 1, wherein said bottom portion is maintained by use of a fastening means.

5. The inflated balloon and gondola as described in claim 1, wherein said bottom portion is a rectangular container.

6. The inflated balloon and gondola as described in claim 1, wherein said bottom portion is a triangular container.

7. The inflated balloon and gondola as described in claim 1, wherein said bottom portion is a cylinder.

* * * * *